US007024128B2

(12) United States Patent
Hiroto

(10) Patent No.: US 7,024,128 B2
(45) Date of Patent: Apr. 4, 2006

(54) IMAGE FORMING APPARATUS AND METHOD

(75) Inventor: Ohishi Hiroto, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 20 days.

(21) Appl. No.: 10/668,957

(22) Filed: Sep. 24, 2003

(65) Prior Publication Data

US 2004/0141767 A1 Jul. 22, 2004

(30) Foreign Application Priority Data

Sep. 24, 2002 (JP) ..... 2002-276777

(51) Int. Cl.
*G03G 15/00* (2006.01)

(52) U.S. Cl. ..... 399/88; 399/90

(58) Field of Classification Search ..... 219/216; 399/69, 70, 82, 88, 107, 108; 307/44, 48, 307/59, 66, 87

See application file for complete search history.

(56) References Cited

U.S. PATENT DOCUMENTS 6,531,689 B1 3/2003 Ohishi et al.
6,542,705 B1 * 4/2003 Fujita et al. ..... 399/69
6,630,651 B1 10/2003 Ohishi et al.

FOREIGN PATENT DOCUMENTS

JP 2000-098799 4/2000
JP 2002-162854 6/2002
JP 2002-184554 6/2002

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including a heater configured to heat and fix a toner image formed on a recording medium a detector configured to detect a current supplied from an external power source to the image forming apparatus and a battery configured to supply power to said heater. Also included is a charger configured to charge the battery with the power supplied from the external power source and a controller configured to control the charger such that a current supplied from the charger to the battery changes based on the current detected by the detector.

54 Claims, 5 Drawing Sheets

FIG. 5

| CATEGORY | | STANDARD OF ENERGY CONSUMING RATE (Wh/h) |
|---|---|---|
| KIND OF COPIER | COPYING SPEED (NUMBER/MIN) | |
| A3 | NOT MORE THAN 10 | 19 |
| | NOT LESS THAN 11, NOT MORE THAN 20 | 55 |
| | NOT LESS THAN 21, NOT MORE THAN 30 | 99 |
| | NOT LESS THAN 31, NOT MORE THAN 40 | 125 |
| | NOT LESS THAN 41, NOT MORE THAN 50 | 176 |
| | NOT LESS THAN 51, NOT MORE THAN 60 | 208 |
| | NOT LESS THAN 61, NOT MORE THAN 70 | 257 |
| | NOT LESS THAN 71, NOT MORE THAN 80 | 286 |
| | NOT LESS THAN 81, NOT MORE THAN 85 | 369 |

IMAGE FORMING APPARATUS AND METHOD

BACKGROUND OF THE INVENTION

1. Field of the Invention

The present invention relates to an image forming apparatus and method. More specifically, the present invention relates to an image forming apparatus and method in which a controller controls a charger such that a current supplied from the charger to a battery changes based on a detected current supplied to the image forming apparatus.

2. Description of the Related Art

A background image forming apparatus such as a copier, a facsimile, or a printer fixes a toner image onto a record medium with heat to make a copied or a recorded medium. The toner image is fixed via a fixing device onto the record medium, because the toner image melts, softens and permeates into the record medium. The record medium is also conveyed while being nipped in the fixing device.

Japanese Published Unexamined Patent Application No. 2002-184554 shows an image forming apparatus including a heater and a battery. In this application, the temperature of the heater can be rapidly increased because the battery supplies power to the heater.

Further, Japanese Published Unexamined Patent Application No. Hei 10-282821 shows an image forming apparatus including a heater, a main power source and a battery. In this application, the battery is charged by the main power source during a standby time, and the battery discharges energy to the heater during a ramp-up period.

Turning now to FIG. 3, which illustrates a portion of a background image forming apparatus. As shown, the portion 20 of the image forming apparatus includes a controller 3 with a driver (not shown), a fixing device 4, a heating switch 7, a charger 8, a switching member 9, a battery 10, a voltage detector 11 for detecting a voltage of the battery 10, and a power source 21. The power source 21 is supplied with power from an external power source 2 and supplies power for driving, e.g. 24V, and for controlling (e.g. 5V) to the controller 3. The fixing device 4 includes a fixing member and a member opposite to the fixing member (not shown), a temperature sensor 22 for detecting a temperature of the fixing member, a first heater 5 and a second heater 6 both configured to heat the fixing member. The fixing member and the member opposite to the fixing member form a nip in which a record medium is passed between. Further, the switching member 9 includes a charging switch for connecting or disconnecting the charger 8 to the battery 10 and a discharging switch for connecting or disconnecting the battery 10 to the second heater 6.

According to the structure described above, the charger 8 charges the battery 10 via the outside power source 2 when the switching member 9 connects the charger 8 to the battery 10. In addition, the battery 10 supplies power to the second heater 6 when the switching member 9 connects the battery 10 to the second heater 6, and meanwhile the outside power source 2 supplies power to the first heater 5 independently of the battery 10. Further, the controller 3 is supplied with power from the power source 21, and receives a temperature detecting signal A from the temperature sensor 22 and a voltage detecting signal B from the voltage detector 11. Based on the signal A and B, the controller 3 outputs a control signal C to switch on-off the heating switch 7 and a control signal D to switch the switching member 9.

Thus, the first heater 5 and the second heater 6 heat the fixing member, and thereby a toner image is heated by the fixing member and fixed onto the record medium while passing through the nip.

Next, FIG. 4A illustrates a timing diagram showing power supplied from the outside power source 2 to the background image forming apparatus without the second heater 6 as a comparative example, and FIG. 4B is a timing diagram showing power supplied from the outside power source 2 to the background image forming apparatus with the second heater 6.

In the background image forming apparatus in FIGS. 3 and 4B, the controller 3 controls the switching member 9 such that the battery 10 connects to the heater 6 during a ramp-up period. Thereby, it is possible to rapidly raise the temperature of the fixing member and thus shorten the ramp-up period. Meanwhile, the controller 3 controls the switching member 9 such that the charger 8 is connected to the battery 10 during a standby time. Therefore, the battery 10 is charged until a necessary voltage is achieved to supply power to the heater 6 at the next ramp-up period.

However, the present inventor determined that the background image forming apparatus does not efficiently charge the battery 10 as described below. In more detail, FIG. 5 is a table showing the relation between a copying speed and a standard of energy consuming rate for a copier using an A3 size record medium. The table is based on a target standard in 2006 in the Japanese Rationalization in Energy Use Law. The following expression is a calculated result of the energy consuming rate in FIG. 4A when the copying speed is more than 40 and not more than 50. The electric energy is 800 W*3 min during a ramp-up period, 1100 W*2 min during copying, 180 W*15 min during a standby time, and 80 W*40 min during a low-power mode. That is, (800*3)+(1000*2)+(180*15)+(80*40)/60=171.6<176 Wh/h so the target standard is satisfied.

Further, the following expression is a calculated result of the energy consuming rate in FIG. 4B, when the charging energy is 150 W*15 min during copying, the ramp-up period is 1 min, and thereby the low-power mode is 42 min in addition to the above condition. That is, (800*1)+(1000*2)+(330*15)+(80*40)/60=185.2>176 Wh/h and the target standard is not satisfied.

SUMMARY OF THE INVENTION

Accordingly, an object of the present invention is to solve the above-noted and other problems.

To achieve these and other objects, the present invention provides a novel image forming apparatus including a heater configured to heat and fix a toner image formed on a recording medium, a detector configured to detect a current supplied from an outside power source to the image forming apparatus, and a battery configured to supply power to said heater. Also included is a charger configured to charge the battery with the power supplied from the outside power source, and a controller configured to control the charger such that a current supplied from the charger to the battery changes based on the current detected by the detector.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 5 is a table showing the relation between a copying speed and a standard of energy consuming rate for a copier using an A3 size record medium.

DETAILED DESCRIPTION OF THE PREFERRED EMBODIMENTS

Figure 1:
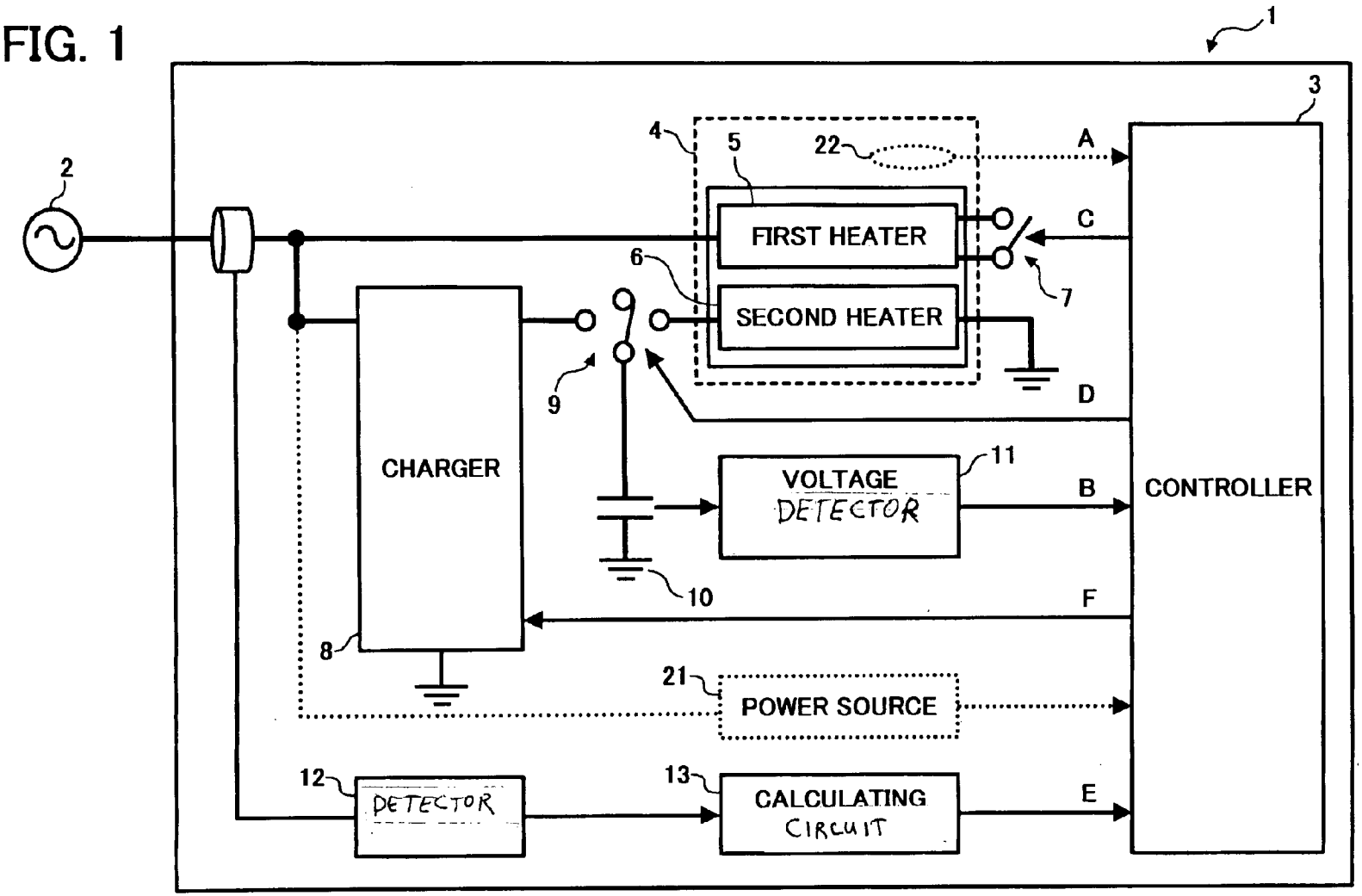
FIG. 1 is a block diagram of a portion an image forming apparatus according to a first embodiment of the present invention.

Hereinafter, the description will be made of embodiments of the present invention with reference to the drawings, wherein like reference numerals designate identical or corresponding parts through the several views.

Figure 3:
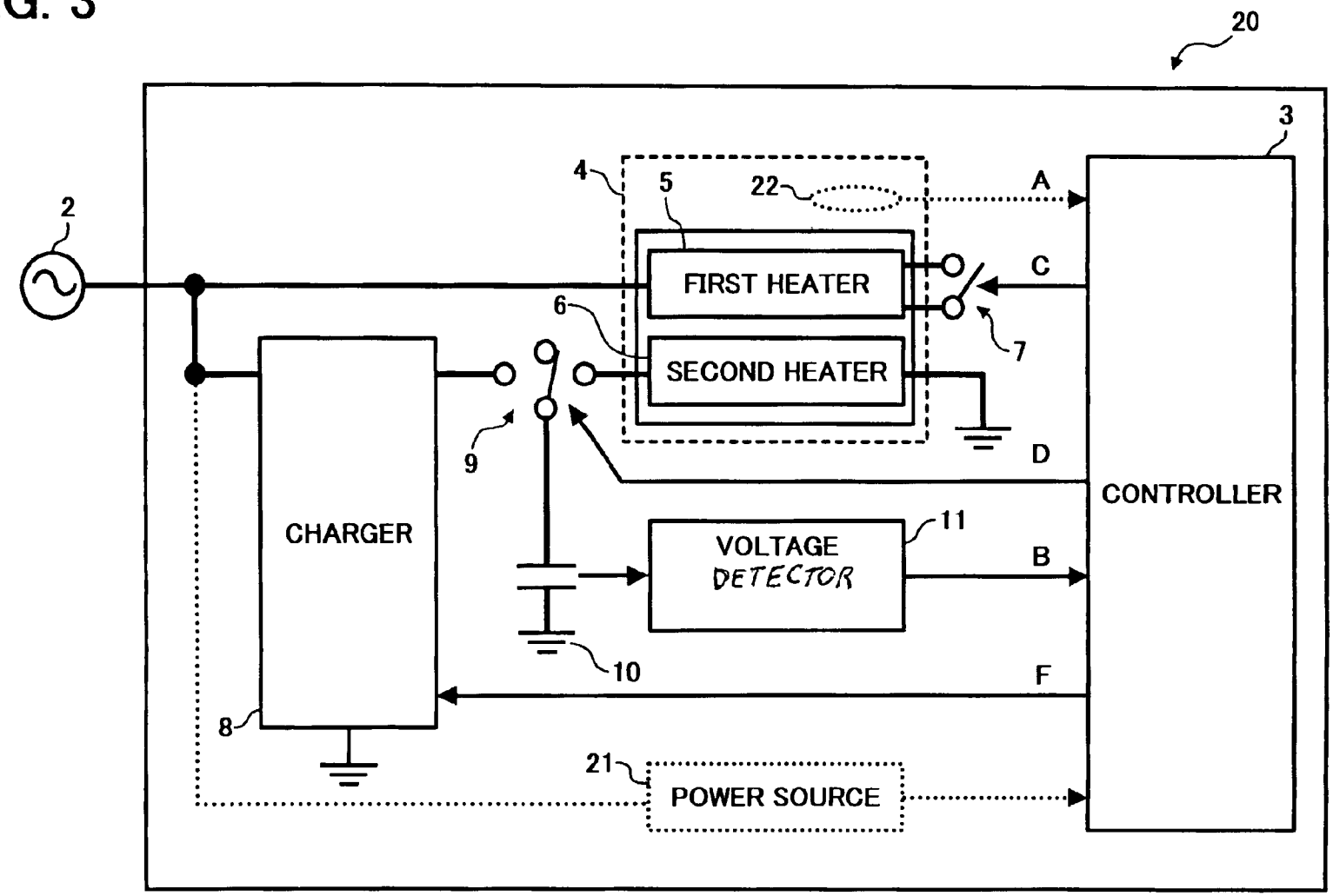
FIG. 3 is a block diagram of a portion of a background image forming apparatus.

Turning first to FIG. 1, which is a block diagram of a portion 1 of an image forming apparatus according to a first embodiment of the present invention. As shown, the portion 1 of the image forming apparatus includes a detector 12, and a calculating circuit 13 in addition to the image forming apparatus 20 shown in FIG. 3. The detector 12 detects a value of a current and voltage supplied from the outside power source 2 to the portion 1 of the image forming apparatus. Further, the calculating circuit 13 calculates a power based on the current and the voltage values detected by the detector 12, and then outputs a signal E indicative of the calculated power to the controller 3. The calculating circuit 13 is shown as being separate from the controller 3, but may also be included in the controller 3.

Figures 2A, 2B, 2C:
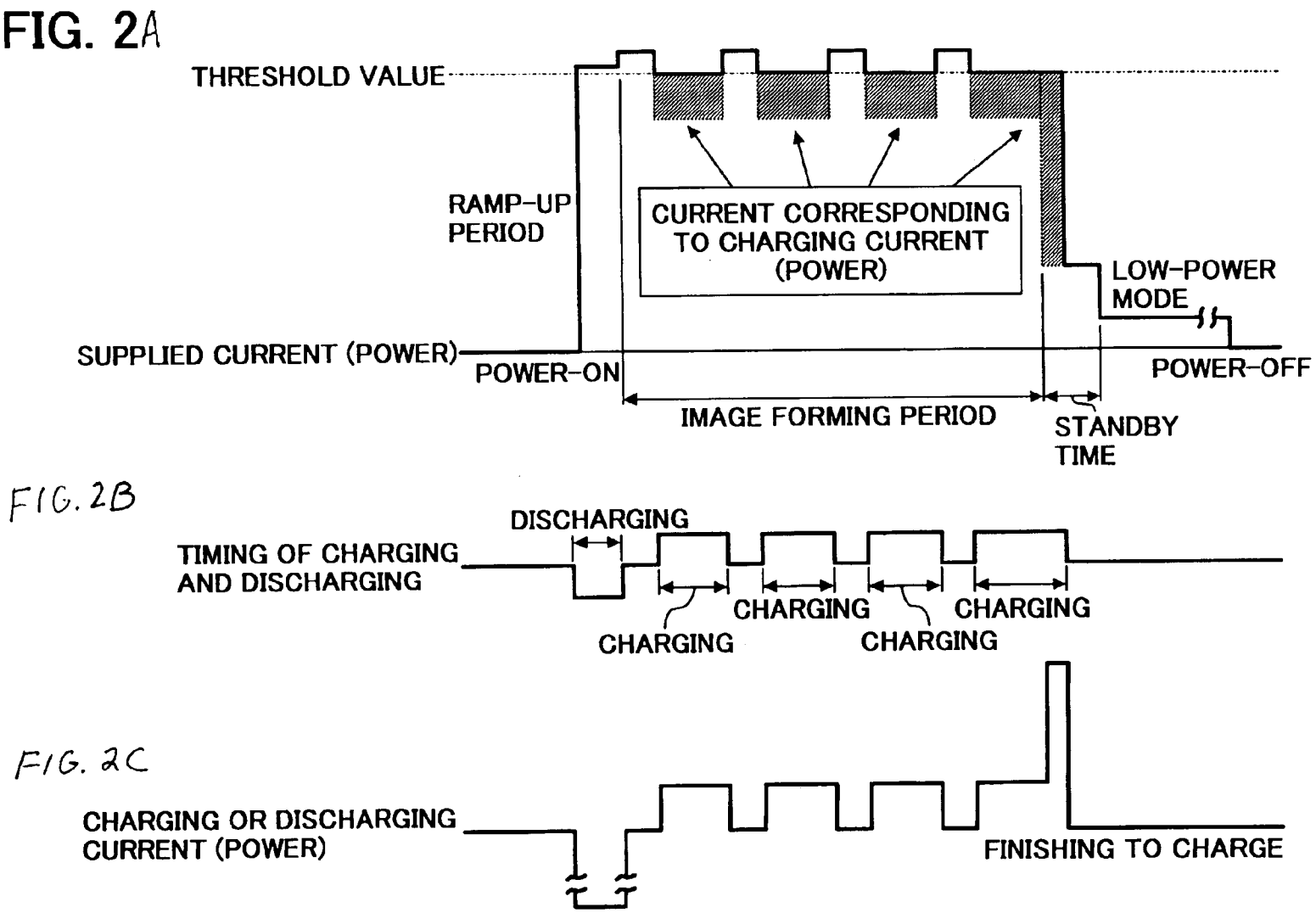
FIGS. 2A–2C are timing diagrams showing the timings for the power supplied from an outside power source to the image forming apparatus, the timings for charging and discharging a battery, and the timings for charging or discharging the power in the first embodiment, respectively.

Next, FIGS. 2A–2C illustrate timing diagrams showing timings for the power supplied from the outside power source 2 to the portion of the image forming apparatus 1, the timings for charging and discharging the battery, and the timings for charging or discharging the power in the first embodiment. With reference to FIGS. 1 and 2A, during a ramp-up period, the controller 3 controls the switching member 9 such that the battery 10 connects to the second heater 6. During an image forming period, the power and the current supplied from the outside power source 2 to the image forming apparatus 1 changes according to how much power is supplied to each component in the image forming apparatus 1 such as an image scanning unit, an image forming unit, etc. Then, the controller 3 controls the switching member 9 such that the charger 8 is connected to the battery 10 based on the current detected by the detector 12. The controller 3 also controls the charger 8 such that the current supplied from the charger 8 to the battery 10 changes based on the current detected by the detector 12.

Further, as shown in FIG. 2A, the current supplied to the apparatus is not always constant. Thus, during periods when all of the current from the outside source is not being used (i.e., some of the components are not currently being operated and thus do not require power), the excess current is used to charge the battery by switching to connect the charger 8 to the battery 10 as shown in FIG. 2B. Note that the shaded area in FIG. 2A illustrates time periods when not all of the current is being used by the image forming apparatus, and FIG. 2B illustrates how the battery is charged during these time periods. FIG. 2C illustrates power charged and discharged by the image forming apparatus.

In more detail, the controller 3 compares the power calculated by the calculating circuit 13 to a threshold value of power, and controls the switching member 9 such that the charger 8 is connected to the battery 10 when the calculated power is less than the threshold value of the power as shown in FIGS. 2A and 2B. The threshold value of the power is not more than a rated apparent power. In addition, the controller 3 controls the charger 8 such that the charger 8 supplies a constant current to the battery 10 and supplies a power that corresponds to a difference between the calculated power and the threshold value of the power as shown in FIG. 2C.

In this embodiment, the battery 10 includes an electric double-layer capacitor, which can supply a higher-density power that is at least three times that of a lead acid battery and a nickel cadmium battery, and thus can supply a large amount of power in a short time. Further, the electric double-layer capacitor can be rapidly charged in a few seconds using a large current, and thereby the electric double-layer capacitor can be charged even though a time period for charging is short during the image forming period as shown in FIG. 2A, for example.

In addition, the electric double-layer capacitor charges and discharges by physically absorbing ions and not by chemical reaction. Thus, the capacitor's lifetime is less vulnerable to a shortened life span due to the battery being repeatedly charged and discharged. For example, a lifetime of the nickel cadmium battery lasts for about 500 to 1,000 charging and discharging times, which is equivalent to about a month if the battery is charged and discharged 20 times a day. Meanwhile, the capacitor's lifetime lasts for about 100,000 times of charging and discharging. Therefore, it is possible to significantly lengthen the lifetime of the battery 10 when a electric double-layer capacitor is used.

Figure 4A:
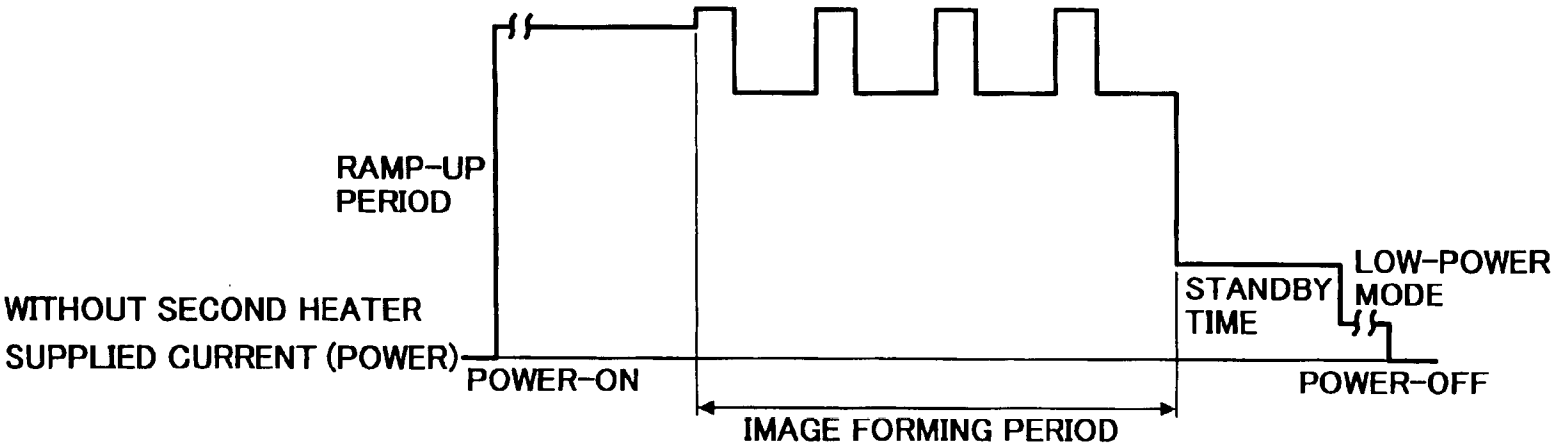
FIG. 4A is a timing diagram showing timings for power supplied from an outside power source to the background image forming apparatus without a second heater as a comparative example.
Figure 4B:
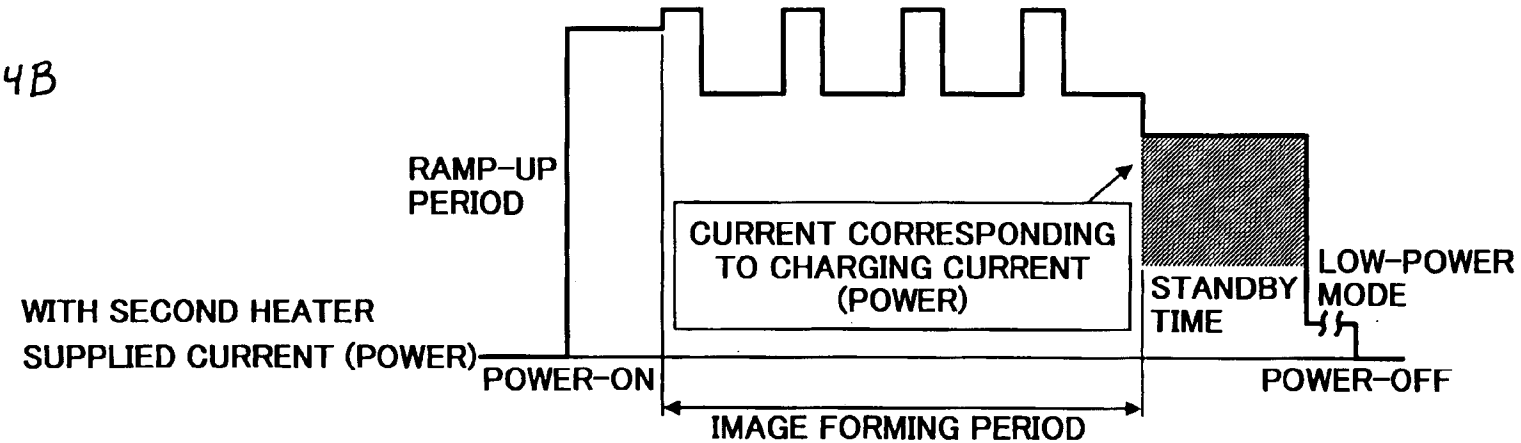
FIG. 4B is a timing diagram showing timings for power supplied from the outside power source to the background image forming apparatus with a second heater such as shown in FIG. 3.

In addition, when the image forming period is long, it is possible to completely charge the battery 10 during this image forming period. However, when the image forming period is short, the battery 10 is also charged during the standby time as shown in FIGS. 2A and 2B. In addition, as shown in FIGS. 2A and 2B, a lot of current from the external power source 2 can be used to charge the battery during the standby time because of the large difference between the calculated power and the threshold value of the power. Thus, the standby time period does not have to be lengthened to charge the battery 10, which differs from the lengthy standby time period needed to charge the battery shown in FIG. 4B.

Further, as discussed above, the electric double-layer capacitor can supply a large amount of power in a short time. Therefore, it is possible to be exempt from the Japanese Rationalization Energy Use Law, which requires that the standby time period be not more than 15 min when the ramp-up period is not more than 30 sec.

Turning now to the following expression, which is a calculated result of the energy consuming rate when the copying speed is more than 40 and not more than 50. In this instance, the electric energy is 800 W*30 sec during a ramp-up period, 1500 W*2 min during copying, 1500 W*30 sec during a standby time period while the battery is charged, 180 W*30 sec during a standby time without the battery being charged, and 80 W*56.5 min during a low-power mode. That is, (800*0.5)+(1500*2)+(1500*0.5)+(180* 0.5)+(80*56.5)/60=146<<176 Wh/h and the target standard is satisfied by a greater margin than in the background apparatus.

Further, the battery 10 disclosed in the embodiments above may also supply power to the second heater 6 during the image forming period, and the first heater 5 does not necessarily have to be included in the image forming apparatus 1.

In a modification of the first embodiment, the controller 3 compares the current detected by the detector 12 with a threshold value of the current. Then, the controller 3 controls the switching member 9 such that the charger 8 is connected to the battery 10 when the detected current is less than the threshold value of the current. Further, the threshold value of the current is determined based on a rated apparent power and voltage. In addition, the controller 3 controls the charger 8 such that the charger 8 supplies a constant current to the battery 10. The charger 8 preferably supplies the constant current in correspondence with a difference between the detected current and the threshold value of the current.

In another modification of the first embodiment, the image forming apparatus includes a detecting circuit (not shown) for detecting a power consumption of the image forming apparatus except the power used by the detector 12. In this instance, the detecting circuit detects the power consumption by detecting whether each electric load in the image forming apparatus is in an ON state or an OFF state, or by a sequence program that controls each electric load in the image forming apparatus.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus comprising:

a heater configured to heat and fix a toner image formed on a recording medium;

a detector configured to detect a current supplied from an external power source to the image forming apparatus;

a battery configured to supply power to the heater;

a charger configured to charge the battery with power supplied from the external power source; and a controller configured to control the charger such that a current supplied from the charger to the battery changes based on the current detected by the detector during an image forming period.

2. The image forming apparatus according to claim 1, wherein the heater receives power supplied from the external power source independently of the battery.

3. The image forming apparatus according to claim 1, wherein the heater includes a first heater supplied with power from the external power source and a second heater supplied with power from the battery.

4. The image forming apparatus according to claim 1, wherein the battery includes an electric double-layer capacitor.

5. The image forming apparatus according to claim 1, further comprising:

a discharging switch configured to connect and disconnect the battery to the heater, wherein said controller controls the discharging switch such that the battery is connected to the heater during a ramp-up period of the image forming apparatus.

6. The image forming apparatus according to claim 1, further comprising:

a charging switch configured to connect and disconnect the charger to the battery, wherein said controller controls the charging switch such that the charger is connected to the battery during an image forming period of the image forming apparatus.

7. The image forming apparatus according to claim 1, further comprising:

a charging switch configured to connect and disconnect the charger to the battery, wherein said controller compares the current detected by the detector to a threshold current value, and controls the charging switch such that the charger is connected to the battery when the current detected by the detector is less than the threshold current value.

8. The image forming apparatus according to claim 7, wherein the controller controls the charger such that the charger supplies a constant current to the battery.

9. The image forming apparatus according to claim 8, wherein said controller controls the charger such that the constant supplied current is in correspondence with a difference between the current detected by the detector and the threshold current value.

10. The image forming apparatus according to claim 1, wherein the detector detects a voltage supplied from the external power source to the image forming apparatus, and wherein the controller controls the charger such that power supplied from the charger to the battery changes based on the voltage detected by the detector.

11. The image forming apparatus according to claim 10, further comprising:

a charging switch configured to connect and disconnect the charger to the battery, wherein the controller compares a power calculated based on the current and the voltage detected by the detector to a threshold power value, and controls the charging switch such that the charger is connected to the battery when the calculated power is less than the threshold power value.

12. The image forming apparatus according to claim 11, wherein the controller controls the charger such that the charger supplies a constant power to the battery.

13. The image forming apparatus according to claim 12, wherein the controller controls the charger such that the constant supplied power is in correspondence with a difference between the calculated power and the threshold value of the power.

14. An image forming apparatus comprising:

a heater configured to heat and fix a toner image forming on a recording medium;

a detector configured to detect a current supplied from an external power source to the image forming apparatus;

a battery configured to supply power to the heater;

a charger configured to charge the battery with power supplied from the external power source;

a charging switch configured to connect and disconnect the battery to the charger; and a controller configured to control the charging switch such that the charger connects to the battery based on the current detected by the detector during an image forming period.

15. An image forming apparatus comprising:

a heater configured to heat and fix a toner image formed on a recording medium;

a detector configured to detect a power consumption of the image forming apparatus;

a battery configured to supply power to the heater;

a charger configured to charge the battery with power supplied from an external power source; and a controller configured to control the charger such that a current supplied from the charger to the battery changes based on the detected power consumption during an image forming period.

16. An image forming apparatus comprising:

a heater configured to heat and fix a toner image formed on a recording medium;

a detector configured to detect a power consumption of the image forming apparatus;

a battery configured to supply power to the heater;

a charger configured to charge the battery with power supplied from an external power source;

a charging switch configured to connect and disconnect the battery to the charger; and a controller configured to control the charging switch such that the charger connects to the battery based on the detected power consumption during an image forming period.

17. An image forming apparatus comprising:

a heater configured to heat and fix a toner image formed on a recording medium;

a battery configured to supply power to the heater;

a charger configured to charge the battery with power supplied from an external power source;

a charging switch configured to connect and disconnect the battery to the charger; and a controller configured to control the charging switch such that the charger connects to the battery during an image forming period during an image forming period.

18. The image forming apparatus according to claim 17, further comprising:

a discharging connect and disconnect the battery to the heater, wherein the controller controls said discharging switch such that the battery is connected to the heater during a ramp-up period of the image forming apparatus.

19. An image forming method comprising:

heating and fixing, via a heater, a toner image formed on a recording medium;

detecting a current supplied from an external power source to the image forming apparatus;

supplying power to the heater via a battery;

charging, via a charger, the battery with power supplied from the external power source; and controlling the charging step such that a current supplied via the charging step to the battery changes based on the current detected by the detecting step, said controlling performed during said heating and fixing.

20. The image forming method according to claim 19, further comprising:

supplying the heater with power from the external power source independently of the battery.

21. The image forming method according to claim 19, wherein the heater includes a first heater supplied with power from the external power source and a second heater supplied with power from the battery.

22. The image forming method according to claim 19, wherein the battery includes an electric double-layer capacitor.

23. The image forming method according to claim 19, further comprising:

connecting and disconnecting the battery to the heater, wherein the controlling step controls the connecting and disconnecting step such that the battery is connected to the heater during a ramp-up period of the image forming apparatus.

24. The image forming method according to claim 19, further comprising:

connecting and disconnecting the charger to the battery, wherein said controlling step controls the connecting and disconnecting step such that the charger is connected to the battery during an image forming period of the image forming apparatus.

25. The image forming method according to claim 19, further comprising:

connecting and disconnecting the charger to the battery, wherein said controlling step compares the current detected by the detecting step to a threshold current value, and controls the connecting and disconnecting step such that the charger is connected to the battery when the current detected by the detecting step is less than the threshold current value.

26. The image forming method according to claim 25, wherein the controlling step controls the charger such that the charger supplies a constant current to the battery.

27. The image forming method according to claim 26, wherein said controlling step controls the charger such that the constant supplied current is in correspondence with a difference between the current detected by the detecting step and the threshold current value.

28. The image forming method according to claim 19, wherein the detecting step detects a voltage supplied from the external power source to the image forming apparatus, and wherein the controlling step controls the charger such that power supplied from the charger to the battery changes based on the voltage detected by the detecting step.

29. The image forming method according to claim 28, further comprising:

connecting and disconnecting the charger to the battery, wherein the controlling step compares a power calculated based on the current and the voltage detected by the detecting step to a threshold power value, and controls the connecting and disconnecting step such that the charger is connected to the battery when the calculated power is less than the threshold power value.

30. The image forming method according to claim 29, wherein the controlling step controls the charger such that the charger supplies a constant power to the battery.

31. The image forming method according to claim 30, wherein the controlling step controls the charger such that the constant supplied power is in correspondence with a difference between the calculated power and the threshold value of the power.

32. An image forming method comprising:

heating and fixing, via a heater, a toner image forming on a recording medium;

detecting a current supplied from an external power source to the image forming apparatus;

supplying power to the heater via a battery;

charging, via a charger, the battery with power supplied from the external power source;

connecting and disconnecting the battery to the charger; and controlling the connecting and disconnecting step such that the charger connects to the battery based on the current detected by the detecting step, said controlling performed during said heating and fixing.

33. An image forming method comprising:

heating and fixing, via a heater, a toner image formed on a recording medium;

detecting a power consumption of the image forming apparatus;

supplying power to the heater via a battery;

charging, via a charger, the battery with power supplied from an external power source; and controlling the charger such that a current supplied from the charger to the battery changes based on the detected power consumption, said controlling performed during said heating and fixing.

34. An image forming method comprising:

heating and fixing, via a heater, a toner image formed on a recording medium;

detecting a power consumption of the image forming apparatus;

supplying power to the heater via a battery;

charging, via a charger, the battery with power supplied from an external power source;

connecting and disconnecting the battery to the charger; and controlling the connecting and disconnecting step such that the charger connects to the battery based on the detected power consumption, said controlling performed during said heating and fixing.

35. An image forming method comprising:

heating and fixing, via a heater, a toner image formed on a recording medium;

supplying power to the heater via a battery;

charging, via a charger, the battery with power supplied from an external power source;

connecting and disconnecting the battery to the charger; and controlling the connecting and disconnecting step such that the charger connects to the battery during an image forming period, said controlling performed during said heating and fixing.

36. The image forming method according to claim 35, further comprising:

connecting and disconnecting the battery to the heater, wherein the controller controls the step of connecting and disconnecting the battery to the heater such that the battery is connected to the heater during a ramp-up period of the image forming apparatus.

37. An image forming system comprising:

means for heating and fixing a toner image formed on a recording medium;

means for detecting a current supplied from an external power source to the image forming apparatus;

means for supplying power to the heating means;

means for charging the battery with power supplied from the external power source; and means for controlling the charging means such that a current supplied via the charging means to the supplying means changes based on the current detected by the detecting means during an image forming period.

38. The image forming system according to claim 37, wherein the heating means receives power supplied from the external power source independently of the battery.

39. The image forming system according to claim 37, wherein the heating means includes a first heater supplied with power from the external power source and a second heater supplied with power from the supplying means.

40. The image forming system according to claim 37, wherein the supplying means includes an electric double-layer capacitor.

41. The image forming system according to claim 37, further comprising:

means for connecting and disconnecting the supplying means to the heating means, wherein the controlling means controls the connecting and disconnecting means such that the supplying means is connected to the heating means during a ramp-up period of the image forming apparatus.

42. The image forming system method to claim 37, further comprising:

means for connecting and disconnecting the charging means to the supplying means, wherein said controlling means controls the connecting and disconnecting means such that the charging means is connected to the supplying means during an image forming period of the image forming apparatus.

43. The image forming system according to claim 37, further comprising:

means for connecting and disconnecting the charging means to the supplying means, wherein said controlling means compares the current detected by the detecting means to a threshold current value, and controls the connecting and disconnecting means such that the charging means is connected to the supplying means when the current detected by the detecting means is less than the threshold current value.

44. The image forming system according to claim 43, wherein the controlling means controls the charging means such that the charging means supplies a constant current to the supplying means.

45. The image forming system according to claim 44, wherein said controlling means controls the charger such that the constant supplied current is in correspondence with a difference between the current detected by the detecting means and the threshold current value.

46. The image forming system according to claim 37, wherein the detecting means detects a voltage supplied from the external power source to the image forming apparatus, and wherein the controlling means controls the charger such that power supplied from the charging means to the supplying means changes based on the voltage detected by the detecting means.

47. The image forming system according to claim 46, further comprising:

means for connecting and disconnecting the charging means to the supplying means, wherein the controlling means compares a power calculated based on the current and the voltage detected by the detecting means to a threshold power value, and controls the connecting and disconnecting means such that the charging means is connected to the supplying means when the calculated power is less than the threshold power value.

48. The image forming system according to claim 47, wherein the controlling means controls the charging means such that the charging means supplies a constant power to the supplying means.

49. The image forming system according to claim 48, wherein the controlling means controls the charging means such that the constant supplied power is in correspondence with a difference between the calculated power and the threshold value of the power.

50. An image forming system comprising:

means for heating and fixing a toner image forming on a recording medium;

means for detecting a current supplied from an external power source to the image forming apparatus;

means for supplying power to the heating means;

means for charging the supplying means with power supplied from the external power source;

means for connecting and disconnecting the supplying means to the charging means; and means for controlling the connecting and disconnecting means such that the charging means connects to the supplying means based on the current detected by the detecting means during an image forming period.

51. An image forming system comprising:

means for heating and fixing a toner image formed on a recording medium;

means for detecting a power consumption of the image forming apparatus;

means for supplying power to the heating means;

means for charging the supplying means with power supplied from an external power source; and means for controlling the charging means such that a current supplied from the charging means to the supplying means changes based on the detected power consumption during an image forming period.

52. An image forming system comprising:

means for heating and fixing a toner image formed on a recording medium;

means for detecting a power consumption of the image forming apparatus;

means for supplying power to the heating means;

means for charging the battery with power supplied from an external power source;

means for connecting and disconnecting the supplying means to the charging means; and means for controlling the connecting and disconnecting means such that the charging means connects to the supplying means based on the detected power consumption during an image forming period.

53. An image forming system comprising:

means for heating and fixing a toner image formed on a recording medium;

means for supplying power to the heating means;

means for charging the supplying means with power supplied from an external power source;

means for connecting and disconnecting the supplying means to the charging means; and means for controlling the connecting and disconnecting means such that the charging means connects to the supplying means during an image forming period.

54. The image forming system according to claim 53, further comprising:

means for connecting and disconnecting the supplying means to the heating means;

wherein the controlling means controls the means for connecting and disconnecting the supplying means to the heating means such that the supplying means is connected to the heating means during a ramp-up period of the image forming apparatus.

* * * * *